US006513834B1

(12) United States Patent
Blomquist

(10) Patent No.: US 6,513,834 B1
(45) Date of Patent: Feb. 4, 2003

(54) MONOPROPELLANT SMOKELESS GAS GENERANT MATERIALS

(75) Inventor: Harold R. Blomquist, Gilbert, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/650,935

(22) Filed: Aug. 29, 2000

(51) Int. Cl.[7] ..... B60R 21/28

(52) U.S. Cl. ..... 280/741; 149/19.1; 149/92; 102/531

(58) Field of Search ..... 149/19.1, 92; 102/531; 280/741

(56) References Cited

U.S. PATENT DOCUMENTS 5,198,204 A 3/1993 Bottaro, et al.
5,460,669 A 10/1995 Willer, et al.
5,516,377 A * 5/1996 Highsmith et al. ..... 149/18
5,741,998 A 4/1998 Hinshaw et al.
5,889,161 A 3/1999 Bottaro, et al.
5,976,483 A 11/1999 Langlet, et al.
6,004,410 A * 12/1999 Blomquist ..... 149/45
6,077,371 A * 6/2000 Lundstrom et al. ..... 149/37
6,117,255 A * 9/2000 Blomquist ..... 149/36

* cited by examiner

*Primary Examiner*—Edward A. Miller
(74) *Attorney, Agent, or Firm*—Tarolli, Sundheim, Covell, Tummino & Szabo L.L.P.

(57) ABSTRACT

An apparatus comprises a vehicle occupant protection device (14) and a gas generating material (18). The gas generating material (18), when ignited, produces a combustion gas that actuates the vehicle occupant protection device (14). At least about 45% by weight of the gas generating material (18) is a mono-propellant selected from the group consisting of 3-nitramino-4-nitrofurazan and hydroxylammonium 3-nitroamino-4-nitrofurazan. 0 to about 48% by weight of the gas generating material (18) is an oxidizer. 0 to about 15% by weight of the gas generating material (18) is a binder.

12 Claims, 1 Drawing Sheet

MONOPROPELLANT SMOKELESS GAS GENERANT MATERIALS

FIELD OF THE INVENTION

The present invention relates to a non-azide based gas generating material. The gas generating material of the present invention is particularly useful for inflating an inflatable vehicle occupant protection device.

BACKGROUND OF THE INVENTION

An inflator for inflating an inflatable vehicle occupant protection device, such as an air bag, contains a body of ignitable gas generating material. The inflator further includes an igniter. The igniter is actuated so as to ignite the body of gas generating material when the vehicle experiences a collision for which inflation of the air bag is desired to help protect a vehicle occupant. As the body of gas generating material burns, it generates a volume of inflation gas. The inflation gas is directed into the air bag to inflate the air bag. When the air bag is inflated, it expands into the vehicle occupant compartment and helps to protect the vehicle occupant.

SUMMARY OF THE INVENTION

The present invention is an apparatus that comprises a vehicle occupant protection device and a gas generating material. The gas generating material, when ignited, produces a combustion gas that actuates the vehicle occupant protection device. At least about 45% by weight of the gas generating material is a mono-propellant selected from the group consisting of 3-nitramino-4-nitrofurazan and hydroxylammonium 3-nitroamino-4-nitrofurazan. An oxidizer is 0 to about 48% by weight of the gas generating material. A binder is 0 to about 15% by weight of the gas generating material.

BRIEF DESCRIPTION OF THE DRAWINGS

The foregoing and other features of the present invention will become more apparent to one skilled in the art upon consideration of the following description of the invention and the accompanying drawing in which.

DESCRIPTION OF PREFERRED EMBODIMENTS

Figure 1:
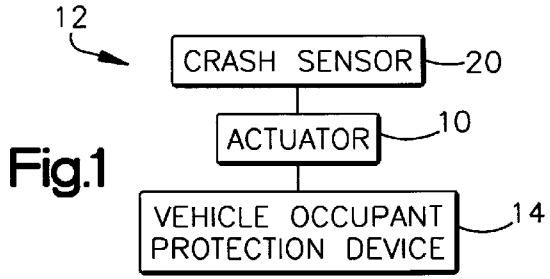
FIG. 1 is a schematic view of a vehicle occupant protection apparatus embodying the present invention.

As representative of the present invention, FIG. 1 illustrates schematically a vehicle occupant protection apparatus 12. The apparatus 12 includes a vehicle occupant protection device 14. In one embodiment of the invention, the vehicle occupant protection device 14 is an air bag. Other vehicle occupant protection devices that can be used in accordance with the present invention are, for example, inflatable seat belts, inflatable knee bolsters, inflatable head liners, inflatable side curtains, knee bolsters operated by inflatable air bags, and seat belts actuated by seat belt pretensioners.

The apparatus 12 comprises an actuator 10. The actuator 10 comprises an igniter 16. The igniter 16 is electrically actuatable to ignite a gas generating material 18 (FIG. 2) contained within the actuator 10. Combustion of the gas generating material 18 produces a combustion gas that actuates the vehicle occupant protection device 14. When the vehicle occupant protection device 14 is actuated, it helps to protect a vehicle occupant from a forceful impact with parts of the vehicle as a result of a crash.

The apparatus 12 also includes a crash sensor 20. The crash sensor 20 is a known device that senses a vehicle condition, such as sudden vehicle deceleration, indicative of a collision or rollover. The crash sensor 20 measures the magnitude and duration of the deceleration. If the magnitude and duration of the deceleration meet or exceed predetermined threshold levels, the crash sensor 20 transmits a signal or causes a signal to be transmitted to actuate the actuator 10.

In the one embodiment of the present invention, the actuator 10 is a pyrotechnic inflator for producing gas to inflate an air bag. The actuator 10, however, could be a gas generator for a seat belt pretensioner (not shown), or a hybrid air bag inflator (not shown).

Figure 2:
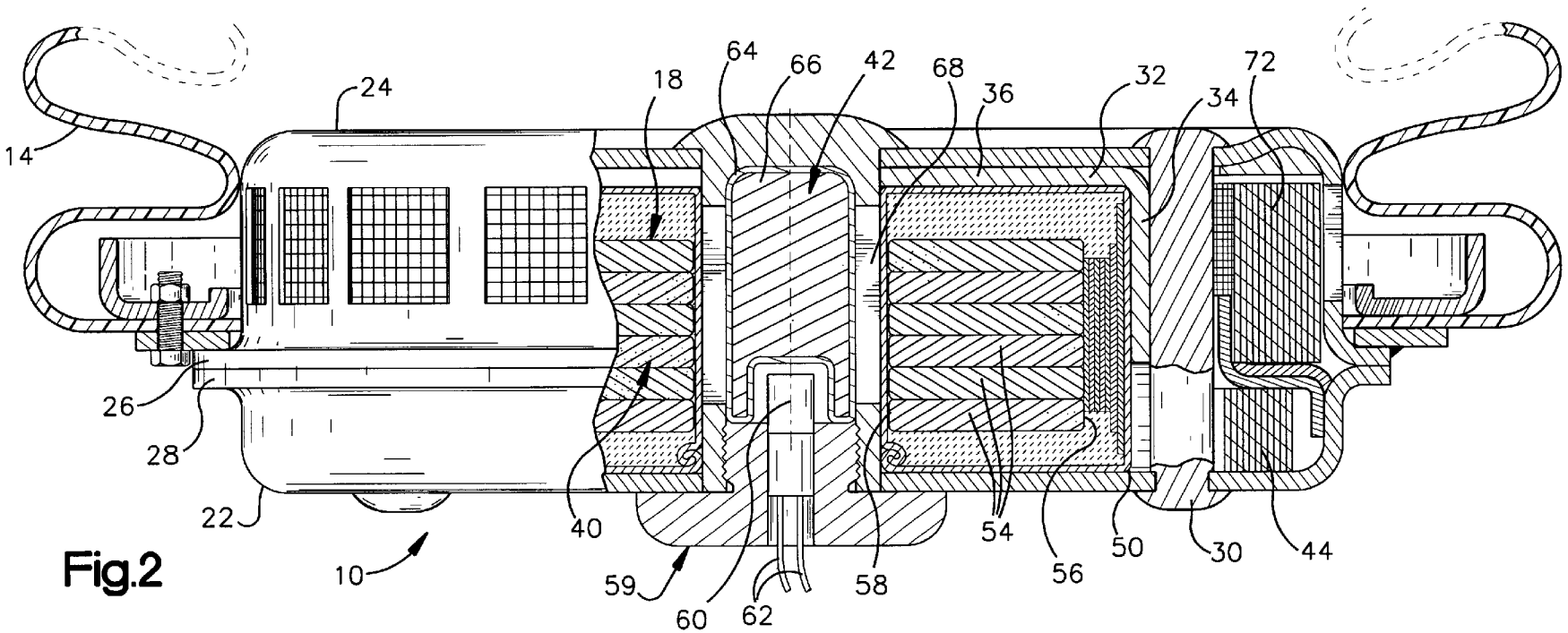
FIG. 2 is an enlarged, sectional view of a part of the apparatus of FIG. 1.

The specific structure of the inflator 10 can vary. Referring to FIG. 2, the inflator 10 comprises a base section 22 and a diffuser section 24. The two sections 22 and 24 are joined together at mounting flanges, 28 and 26, which are attached to each other by a continuous weld (not shown). A plurality of rivets 30 also hold the diffuser section 24 and the base section 22 together.

A combustion cup 32 is seated between the diffuser section 24 and the base section 22. The combustion cup 32 comprises an outer cylindrical wall 34 and an annular top wall 36. The combustion cup 32 divides the inflator 10 into a combustion chamber 40, which is located within the combustion cup 32, and a filtration chamber 44, which is annular in shape and is located outside the combustion cup 32.

The combustion chamber 40 houses an inner container 50, which is hermetically sealed. The inner container 50 holds gas generating material 18, which is in the form of a plurality of gas generating disks 54. The gas generating disks 54 have a generally toroidal configuration with a cylindrical exterior surface 56 and an axially extending hole defined by a cylindrical interior surface 58. The disks 54 are positioned in the container in a stacked relationship with the axially extending holes in alignment. Each disk 54 has generally flat opposed surfaces and may have protuberances on such surfaces to space one disk slightly from another. This configuration of the disks 54 promotes a uniform combustion of the disks 54. The gas generating material could, alternatively, be provided in the form of pellets or tablets.

The cylindrical interior surfaces 58 of the disks 54 encircle an ignition chamber 42. The ignition chamber 42 is defined by a two-piece, tubular igniter housing 59 that fits within the combustion cup 32 and the disks 54 and contains a squib 60. The squib 60 contains a small charge of ignitable material (not shown). Electric leads 62 convey a current to the squib 60. The current is provided when the crash sensor 14, which is responsive to a condition indicative of a vehicle collision, closes an electrical circuit that includes a power source (not shown). The current generates heat in the squib 60 which ignites the ignitable material.

The ignition chamber 42 also has a canister 64 that contains a rapidly combustible pyrotechnic material 66 such as boron potassium nitrate. The rapidly combustible pyrotechnic material 66 is ignited by the small charge of ignitable material of the squib 60. The burning pyrotechnic material 66 exits from the ignition chamber 42 through openings 68 in the igniter housing that lead to the combustion chamber 40. The burning pyrotechnic material 66 penetrates the container 50 and ignites the gas generating disks 54. Other ignition systems capable of igniting the disks 54 are well known and can be used with the present invention.

The inflator 12 also comprises a filter assembly 72 in a filtration chamber 44. The filter assembly 72 is in the flow path between the combustion chamber 40 and the vehicle occupant protection device 14. The filter assembly 72 functions to remove solid products of combustion from the combustion gasses and prevent their entry into the vehicle occupant protection device 14. The filter assembly 72 also cools the products of combustion of the disks 54.

The gas generating material 18 comprises an organic nitrogen containing mono-propellant. By mono-propellant, it is meant a homogenous energetic compound that produces a large volume (i.e., greater that 0.03 moles of gas per gram of mono-propellant) of gas upon combustion and sustains combustion without the addition of an oxidizer source. By organic nitrogen containing, it is meant that the mono-propellants consist essentially of carbon, nitrogen, oxygen, and hydrogen atoms. The organic nitrogen containing mono-propellants of the present invention are oxygen balanced so that upon combustion the mono-propellant produces a combustion product that consists essentially of carbon dioxide ($CO_2$), nitrogen ($N_2$), and water ($H_2O$). In other words, the combustion product is essentially free of carbon monoxide (CO), nitrogen oxides ($NO_x$), and particulates.

The organic nitrogen containing mono-propellants are selected from the group consisting of hydroxyl ammonium 3-nitramino-4-nitrofurazan and 5-aminotetrazolium dinitramide.

Hydroxylammonium 3-nitramino-4-nitrofurazan has an empirical formula of $C_2H_4N_6O_6$ and the following structural formula:

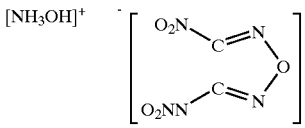

Hydroxylammonium 3-nitramino-4-nitrofurazan is the salt of hydroxylamine and 3-nitramino-4-nitrofurazan. Hydroxylammonium 3-nitramino-4-nitrofurazan can be formed by treating 3,4-diaminofurazan with peroxytrifluoroacetic acid to obtain a blue-green solution. The solution is heated under reflux until light yellow. The light yellow solution is treated with $Na_2CO_3$(aq) and the desired 3-amino-4-nitrofurazan is extracted from the treated solution. The 3-amino-4-nitrofurazan is nitrated with a nitrating acid mixture to obtain 3-nitramino-4-nitrofurazan. The 3-nitramino-4-nitrofurazan is extracted and dried. The 3-nitramino-4-nitrofurazan is dissolved in distilled water and combined with an aqueous hydroxylamine solution. The water is removed from the solution by vacuum evaporation to obtain hydroxylammonium 3-nitramino-4-nitrofurazan powder.

5-aminotetrazolium dinitramide has the empirical formula and the following structural formula:

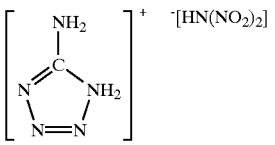

5-aminotetrazolium dinitramide is the salt of 5-aminotetrazole and dinitramidic acid $HN(NO_2)_2$.5-aminotetrazolium dinitramide is prepared by nitrating a carbamate such as ammonium carbamate with a nitrating agent such as nitrating acid mixture to form a dinitramidic acid solution. 5-aminotetrazole is then added to the dinitramidic acid solution to neutralize the dinitramidic acid. The resulting salt formed from the neutralization reaction is 5-aminotetrazolium dinitramide. The water is removed from the solution by vacuum evaporation to obtain 5-aminotetrazolium dinitramide powder.

The organic nitrogen containing mono-propellant is incorporated in the gas generating material in the form of particles. The average particle size of the organic, nitrogen containing mono-propellant is from about 1 $\mu$m to about 100 $\mu$m. Preferably, the average particle size of the organic, nitrogen containing mono-propellant is from about 1 $\mu$m to about 20 $\mu$m.

The organic, nitrogen containing mono-propellant can be utilized as the sole ingredient in the gas generating material since the organic, nitrogen containing mono-propellant is oxygen balanced to produce a non-toxic combustion product that is essentially free of carbon monoxide (CO), nitrogen oxides ($NO_x$), and particulates. The organic, nitrogen containing mono-propellant can be combined with additional materials (e.g., binders, oxidizers, plasticizers, burn rate modifiers, coolants, opacifiers, and desiccants) in the gas generating material. When additional materials are utilized in the gas generating material, the amount of organic, nitrogen containing mono-propellant in the gas generating material is at least about 45% by weight of the gas generating material. More preferably, when additional materials are utilized in the gas generating material, the amount of organic, nitrogen containing mono-propellant is at least about 75% by weight of the gas generating material.

The gas generating material preferably includes a binder to improve the mechanical properties of the gas generating material. A gas generating material for a vehicle occupant protection apparatus should be a resilient solid capable of withstanding shock without permanent deformation at temperatures of about 85° C. and not brittle at temperatures of about −40° C. Suitable binders that can be used to a form a gas generating material that is a resilient solid are well known in the art. Preferred binders are cellulose based binders such as cellulose acetate butyrate and nitrocellulose, polycarbonates, polyurethanes, polyesters, polyethers, polysuccinates, thermoplastic rubbers, polybutadienes, polyolefins, polystyrene, and mixtures thereof. A more preferred binder is KRATON (trademark), a polyethylene/butylene-polystyrene block copolymer manufactured by Shell Chemical Company. A preferred amount of binder is from about 0% to about 15% by weight of the gas generating material. More preferably, the amount of binder in the gas generating material is from about 2.5% to about 10% by weight of the gas generating material.

The gas generating material can also include other ingredients commonly added to a gas generating material such as plasticizers, burn rate modifiers, coolants, opacifiers, and desiccants. These other components are included in the gas generating material in relatively small amounts.

When the binder and/or other ingredients are included in the gas generating material, the gas generating material preferably includes an oxidizer. The binder and the other ingredients are typically oxygen deficient. By oxygen deficient, it is meant that the binder and the other ingredients require an additional oxygen source to combust completely. As a result, a gas generating material that consists of the organic, nitrogen containing mono-propellant, the binder, and other ingredients will produce a combustion product that potentially includes carbon monoxide and nitrogen oxides. It is therefore necessary, when the binder and the other ingredients are included in the gas generating material, that the gas generating material further include an oxidizer to oxygen balance the gas generating material.

The oxidizer can be any oxidizer commonly used in a gas generating material for inflating a vehicle occupant protection device. A preferred oxidizer is an inorganic salt oxidizer. Examples of inorganic salt oxidizers that can be used in a gas generating material for inflating a vehicle occupant protection device are alkali metal nitrates such as sodium nitrate and potassium nitrate, alkaline earth metal nitrates such as strontium nitrate and barium nitrate, alkali metal perchlorates such as sodium perchlorate, potassium perchlorate, and lithium perchlorate, alkaline earth metal perchlorates, alkali metal chlorates such as sodium chlorate, lithium chlorate and potassium chlorate, alkaline earth metal chlorates such as magnesium chlorate and calcium chlorate, ammonium perchlorate, ammonium nitrate, and mixtures thereof.

When ammonium nitrate is used as the oxidizer, the ammonium nitrate is preferably phase stabilized. The phase stabilization of ammonium nitrate is well known. In one method, the ammonium nitrate is doped with a metal cation in an amount that is effective to minimize the volumetric and structural changes associated with phase transitions to pure ammonium nitrate. A preferred phase stabilizer is potassium nitrate. Other useful phase stabilizers include potassium salts such as potassium dichromate, potassium oxalate, and mixtures of potassium dichromate and potassium oxalate. Ammonium nitrate can also be stabilized by doping with copper and zinc ions. Other compounds, modifiers, and methods that are effective to phase stabilize ammonium nitrate are well known and suitable in the present invention.

Ammonium perchlorate, although a good oxidizer, is preferably combined with a non-halogen alkali metal or alkaline earth metal salt. Preferred mixtures of ammonium perchlorate and a non-halogen alkali metal or alkaline earth metal salt are ammonium perchlorate and sodium nitrate, ammonium perchlorate and potassium nitrate, and ammonium perchlorate and lithium carbonate. Ammonium perchlorate produces upon combustion hydrogen chloride. Non-halogen alkali metal or alkaline earth metal salts react with hydrogen chloride produced upon combustion to form alkali metal or alkaline earth metal chloride. Preferably, the non-halogen alkali metal or alkaline earth metal salt is present in an amount sufficient to produce a combustion product that is substantially free (i.e., less than 2% by weight of the combustion product) of hydrogen chloride.

The oxidizer material is incorporated in the autoignition material in the form of particles. The average particle size of oxidizer material is less than about 100 microns. Preferably, the average particle size of the oxidizer material is from about 10 microns to about 30 microns.

The amount of oxidizer in the gas generating material is that amount necessary to oxygen balance the gas generating material so that the carbon and hydrogen in the gas generating material are converted upon combustion to carbon dioxide and water, respectively. The amount oxidizer to oxygen balance the gas generating material is from 0 to about 48% by weight of the gas generating material. A preferred amount is less than about 25% by weight of the gas generating material.

The gas generating material can be prepared by compacting the particles of the organic nitrogen containing monopropellant into the configuration of the gas generating disks 54 or into some other configuration. If included in the gas generating material, additional materials (i.e., binders, oxidizers, plasticizers, burn rate modifiers, coolants, opacifiers, and/or desiccants) are mixed as particles with particles of the organic, nitrogen containing monopropellant in a conventional mixing device. The mixture is then compacted into the configuration of the gas generating disks 54 or into some other configuration.

Optionally, the particles of organic, nitrogen containing mono-propellant (and additional materials if used) may be mixed with a liquid to form a liquid slurry. The liquid slurry is dried, and the dried mixture is compacted into the configuration of the gas generating disk 54 or into some other desired configuration.

EXAMPLE

Examples 1–5 illustrate formulations of gas generating materials comprising hydroxylammonium 3-nitramino-4-nitrofurazan in accordance with the present invention. In Examples 2–5, an oxidizer and a binder are included in the gas generating material. The oxidizers are, respectively, ammonium nitrate (Examples 2 and 4) and potassium perchlorate (Examples 3 and 5). The binders are, respectively, Kraton (Examples 2 and 3) and cellulose acetate butyrate mixed with tributyl citrate (Examples 4 and 5).

The formulations and combustion products for Examples 1–5 are given in Table 1. The combustion products for Examples 1–5 are calculated using the U.S. Navy PEP Thermochemical Equilibrium Code.

TABLE 1

| | EX 1 | EX 2 | EX 3 | EX 4 | EX 5 |
|---|---|---|---|---|---|
| Formulations | | | | | |
| HANNF wt % | 100 | 49.05 | 76.25 | 46.01 | 73.13 |
| AN wt % | 0 | 47.95 | 0 | 47.99 | 0 |
| KP wt % | 0 | 0 | 20.75 | 0 | 20.87 |
| CAB wt % | 0 | 0 | 0 | 3 | 3 |
| TBC wt % | 0 | 0 | 0 | 3 | 3 |
| Kraton wt % | 0 | 3 | 3 | 0 | 0 |
| Wt % of combustion products | | | | | |
| $N_2$ | 40.38 | 36.59 | 30.79 | 35.37 | 29.53 |
| $CO_2$ | 42.30 | 30.63 | 42.14 | 31.50 | 42.97 |
| $H_2O$ | 17.31 | 32.77 | 15.90 | 33.49 | 16.58 |
| KCl | 0 | 0 | 11.17 | 0 | 11.23 |

Table 1 shows that the gas generating materials of Examples 1–5 are all oxygen balanced and produce, upon combustion, a combustion product that comprises nitrogen, carbon dioxide, and water. The amount of oxidizer in Examples 2–5 is determined based on the binder and the oxidizer used in each of the gas generating materials. Where ammonium nitrate is utilized as the oxidizer (Examples 2 and 4), the reaction product is free of particulates. Where potassium perchlorate is used as the oxidizer (Examples 3 and 5), a potassium chloride salt is produced. The potassium chloride salt is capable of being filtered by the filter assembly 72.

Examples 6–12 illustrate formulations of gas generating materials comprising 5-aminotetrazolium dinitramide in accordance with the present invention. In Examples 6–12, an oxidizer and a binder are included in the gas generating material. The oxidizers are, respectively, ammonium nitrate (Examples 7, 9, 11 and 12) and potassium perchlorate (Examples 8 and 10). The binders are, respectively, Kraton (Examples 7 and 8), cellulose acetate butyrate mixed with tributyl citrate (Examples 9 and 10), and nitrocellulose (Examples 11 and 12).

The formulations and combustion products for Examples 6–12 are given in Table 2. The combustion products for Examples 6–12 are calculated using the U.S. Navy PEP Thermochemical Equilibrium Code.

TABLE 2

| | EX 6 | EX 7 | EX 8 | EX 9 | EX 10 | EX 11 | EX 12 |
|---|---|---|---|---|---|---|---|
| Formulations | | | | | | | |
| ATDN wt % | 100 | 49.05 | 76.25 | 46.01 | 73.13 | 83.64 | 89.52 |
| AN wt % | 0 | 47.95 | 0 | 47.99 | 0 | 10.36 | 0 |
| KP wt % | 0 | 0 | 20.75 | 0 | 20.87 | 0 | 4.48 |
| CAB wt % | 0 | 0 | 0 | 3 | 3 | | |
| TBC wt % | 0 | 0 | 0 | 3 | 3 | | |
| Kraton wt % | 0 | 3 | 3 | 0 | 0 | | |
| NC wt % | | | | | | 6 | 6 |
| Wt % of combustion products | | | | | | | |
| $N_2$ | 58.30 | 45.39 | 44.47 | 43.63 | 42.65 | 53.16 | 52.97 |
| $CO_2$ | 22.9 | 21.12 | 27.36 | 22.58 | 28.79 | 24.98 | 26.33 |
| $H_2O$ | 18.8 | 33.48 | 17.00 | 34.15 | 17.64 | 21.85 | 18.29 |
| KCl | 0 | 0 | 11.17 | 0 | 11.23 | 0 | 2.41 |

Table 2 shows that the gas generating materials of Examples 6–12 are all oxygen balanced and produce, upon combustion, a combustion product that comprises nitrogen, carbon dioxide, and water. The amount of oxidizer in examples 6–12 is based on the binder and the oxidizer used in each of the gas generating materials. Where ammonium nitrate is utilized as the oxidizer (Examples 7, 9, 11 and 12), the reaction product is free of particulates. Where potassium perchlorate is used as the oxidizer (Examples 8 and 10), a potassium chloride salt is produced. The potassium chloride salt is capable of being filtered by the filter assembly 72.

From the above description of the invention, those skilled in the art will perceive improvements, changes and modifications in the invention. Such improvements, changes and modifications within the skill of the art are intended to be covered by the appended claims.

Having described the invention, the following is claimed:

1. An apparatus comprising a vehicle occupant protection device and a gas generating material, which when ignited, produces a combustion gas that actuates the vehicle occupant protection device, the gas generating material comprising, at least about 45%, by weight of the gas generating material, hydroxylammonium 3-nitramino-4-nitrofurazan;

a binder, said binder being present in an amount of about 2.5% to about 10% by weight of the gas generating material, and an oxidizer, said oxidizer being present in that amount necessary to oxygen balance the gas generating material so that carbon and hydrogen in the gas generating material are converted upon combustion to carbon dioxide and water.

2. The apparatus of claim 1, wherein the binder is selected from the group consisting of cellulose based binders, polycarbonates, polyurethanes, polyesters, polyethers, polysuccinates, thermoplastic rubbers, polybutadiene, polyolefins, polystyrene, and mixtures thereof.

3. The apparatus of claim 1, wherein the oxidizer is selected from the group consisting of alkali metal nitrates, alkaline earth metal nitrates, alkali metal perchlorates, alkaline earth metal perchlorates, alkali metal chlorates, alkaline earth metal chlorates, ammonium perchlorate, ammonium nitrate, and mixtures thereof.

4. The apparatus of claim 1, wherein the gas generating material comprises at least about 75%, by weight of the gas generating material, hydroxylammonium 3-nitramino-4-nitrofurazan.

5. The apparatus of claim 1, wherein the amount of oxidizer is less than about 25% by weight of the gas generating material.

6. An apparatus comprising a vehicle occupant protection device and a gas generating material, which when ignited, produces a combustion gas that actuates the vehicle occupant protection device, the gas generating material comprising:

at least about 45%, by weight of the gas generating material, hydroxylammonium 3-nitramino-4-nitrofurazan, about 2.5% to about 10%, by weight of the gas generating material, a binder, and ammonium nitrate, wherein the amount of ammonium nitrate is present in that amount necessary to oxygen balance the gas generating material so that carbon and hydrogen in the gas generating material are converted, upon combustion, to carbon dioxide and water.

7. The apparatus of claim 6, wherein the binder is a polyethylene/butylene-polystyrene block copolymer.

8. The apparatus of claim 6 wherein the binder comprises cellulose acetate butyrate.

9. An apparatus comprising a vehicle occupant protection device and a gas generating material, which when ignited, produces a combustion gas that actuates the vehicle occupant protection device, the gas generating material comprising:

at least about 75%, by weight of the gas generating material, hydroxylammonium 3-nitramino-4-nitrofurazan, about 2.5% to about 10% by weight of a binder, and potassium chlorate, wherein the amount of potassium chlorate is present in that amount necessary to oxygen balance the gas generating material so that carbon and hydrogen in the gas generating material are converted, upon combustion, to carbon dioxide and water.

10. The apparatus of claim 9, wherein the binder is a polyethylene/butylene-polystyrene block copolymer.

11. The apparatus of claim 9 wherein the binder comprises cellulose acetate butyrate.

12. An apparatus comprising a vehicle occupant protection device and a gas generating material, which when ignited, produces a combustion gas that actuates the vehicle occupant device, the gas generating material consisting essentially of:

at least about 45%, by weight of the gas generating material, hydroxylammonium 3-nitramino-4-nitrofurazan, about 2.5% to about 10% by weight of a binder, and an oxidizer, said oxidizer being present in that amount effective to oxygen balance the gas generating material so that carbon and hydrogen in the gas generating material are converted, upon combustion, to carbon dioxide and water.

* * * * *